US009791797B2

(12) United States Patent
Sambhy et al.

(10) Patent No.: US 9,791,797 B2
(45) Date of Patent: Oct. 17, 2017

(54) METALLIC TONER COMPOSITIONS

(71) Applicant: Xerox Corporation, Norwalk, CT (US)

(72) Inventors: Varun Sambhy, Pittsford, NY (US); Juan A. Morales Tirado, Henrietta, NY (US); Kirk L. Stamp, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/067,426

(22) Filed: Mar. 11, 2016

(65) Prior Publication Data

US 2017/0261877 A1 Sep. 14, 2017

(51) Int. Cl.

| | |
|---|---|
| ***G03G 9/087*** | (2006.01) |
| ***G03G 9/09*** | (2006.01) |
| ***G03G 9/08*** | (2006.01) |

(52) U.S. Cl.

CPC ..... *G03G 9/0902* (2013.01); *G03G 9/081* (2013.01); *G03G 9/0823* (2013.01); *G03G 9/08755* (2013.01)

(58) Field of Classification Search

CPC ..... G03G 9/08755; G03G 9/0902; G03G 9/0825; G03G 9/09342; G03G 9/081; G03G 9/0802

See application file for complete search history.

(56) References Cited

U.S. PATENT DOCUMENTS

| | | | | |
|---|---|---|---|---|
| 3,681,106 | A | 8/1972 | Burns et al. | |
| 4,298,672 | A | 11/1981 | Lu | |
| 4,533,614 | A | 8/1985 | Fukumoto et al. | |
| 4,657,837 | A | 4/1987 | Morita et al. | |
| 4,693,952 | A | 9/1987 | Koizumi et al. | |
| 4,750,940 | A * | 6/1988 | Higashi | A61K 8/11 524/439 |
| 4,814,249 | A | 3/1989 | Oseto et al. | |
| 4,845,006 | A | 7/1989 | Matsubara et al. | |
| 4,863,824 | A | 9/1989 | Uchida et al. | |
| 4,863,825 | A | 9/1989 | Yoshimoto et al. | |
| 4,917,983 | A | 4/1990 | Uchida et al. | |
| 4,931,370 | A | 6/1990 | Amaya et al. | |
| 4,933,252 | A | 6/1990 | Nishikawa et al. | |
| 4,957,774 | A | 9/1990 | Doi et al. | |
| 4,960,664 | A | 10/1990 | Yamada et al. | |
| 4,973,539 | A | 11/1990 | Sacripante et al. | |
| 4,980,448 | A | 12/1990 | Tajiri et al. | |
| 4,981,939 | A | 1/1991 | Matsumura et al. | |
| 4,988,794 | A | 1/1991 | Kubo et al. | |

(Continued)

FOREIGN PATENT DOCUMENTS

JP 2007079246 A * 3/2007

OTHER PUBLICATIONS

English language machine translation of JP 2007-079246 (Mar. 2007).*

(Continued)

*Primary Examiner* — Christopher Rodee
(74) *Attorney, Agent, or Firm* — Marylou J. Lavoie, Esq. LLC

(57) ABSTRACT

A toner composition including a toner particle having a surface, wherein the toner particle comprises at least one toner resin; a metallic pigment bonded to the surface of the toner particle; and an insulative surface additive disposed over the metallic pigment.

15 Claims, 2 Drawing Sheets

(56) References Cited

U.S. PATENT DOCUMENTS 5,057,596 A 10/1991 Kubo et al.
5,143,809 A 9/1992 Kaneko et al.
5,180,650 A * 1/1993 Sacripante ..... G03G 9/0832 427/419.2
5,227,460 A 7/1993 Mahabadi et al.
5,376,494 A 12/1994 Mahabadi et al.
5,480,756 A 1/1996 Mahabadi et al.
5,500,324 A 3/1996 Mahabadi et al.
5,591,556 A * 1/1997 Shimomura ..... G03G 9/0819 430/109.4
5,601,960 A 2/1997 Mahabadi et al.
5,629,121 A 5/1997 Nakayama
5,650,484 A 7/1997 Hawkins et al.
5,716,751 A 2/1998 Bertrand et al.
5,750,909 A 5/1998 Hawkins et al.
6,063,827 A 5/2000 Sacripante et al.
6,153,348 A 11/2000 Kydd et al.
6,326,119 B1 12/2001 Hollenbaugh et al.
6,358,657 B1 3/2002 Silence et al.
6,359,105 B1 3/2002 Ianni et al.
6,592,913 B2 7/2003 Cook et al.
6,593,049 B1 7/2003 Veregin et al.
6,593,053 B1 7/2003 Chang et al.
6,756,176 B2 6/2004 Stegamat et al.
6,830,860 B2 12/2004 Sacripante et al.
6,979,523 B1 * 12/2005 Landa ..... G03G 9/09 430/109.1
7,326,507 B2 * 2/2008 Schulze-Hagenest .... C09C 1/62 106/403
7,329,476 B2 2/2008 Sacripante et al.
2005/0214666 A1 * 9/2005 Schulze-Hagenest .... C09C 1/62 430/108.2
2005/0214669 A1 * 9/2005 Hayashi ..... G03G 9/081 430/109.4
2006/0216626 A1 9/2006 Sacripante et al.
2008/0107990 A1 5/2008 Field et al.
2008/0236446 A1 10/2008 Zhou et al.
2008/0274295 A1 * 11/2008 Cavero ..... C09D 5/031 427/485
2009/0047593 A1 2/2009 Vanbesien et al.
2010/0216068 A1 * 8/2010 Kotsugai ..... G03G 9/08755 430/109.4
2011/0262858 A1 * 10/2011 Nair ..... G03G 9/0804 430/110.2
2012/0251169 A1 * 10/2012 Aoki ..... G03G 15/0189 399/111
2013/0164668 A1 * 6/2013 Sacripante ..... G03G 9/081 430/108.1
2013/0196258 A1 * 8/2013 Inaba ..... G03G 9/08755 430/105
2013/0244152 A1 * 9/2013 Yoshida ..... G03G 15/6585 430/105
2013/0295351 A1 11/2013 Tyagi et al.
2013/0295502 A1 * 11/2013 Tyagi ..... G03G 13/20 430/124.1
2013/0295504 A1 * 11/2013 Tyagi ..... G03G 9/081 430/137.21
2013/0344427 A1 * 12/2013 Kadota ..... G03G 21/0029 430/105

OTHER PUBLICATIONS

Juan A. Morales-Tirado, et al., "Clear Toner Compositions," U.S. Appl. No. 14/682,948, filed Apr. 9, 2015, not yet published.

* cited by examiner (SEM IMAGE OF SILVER METALLIC TONER SHOWING ALUMINIUM FLAKES BONDED TO TONER SURFACE)

METALLIC TONER COMPOSITIONS

BACKGROUND

Disclosed herein is a toner composition including a toner particle having a surface; a metallic pigment bonded to the surface of the toner particle; and an insulative surface additive disposed over the metallic pigment.

Conventional printing systems for toner applications consist of four stations comprising cyan, magenta, yellow, and black (CMYK) toner stations. Xerox® Corporation is developing printing systems including the concept of a fifth xerographic station to enable gamut extension via the addition of a fifth color or specialty colors. At any given time the machine can run CMYK toners plus a fifth color in the fifth station. To further increase the capability of the new systems and provide novelty printing capability to customers, it is desirable to develop a metallic ink formulation to also be run in the fifth station. Toners capable of making metallic hues, especially silver or golden, are particularly desired by print shop customers for their esthetic appeal, for example, on wedding cards, invitations, advertising, etc. Metallic hues cannot be obtained from CMYK primary color mixtures.

A requirement for achieving a metallic effect is incorporation of a flat reflective pigment in a toner that can reflect light and give the desired metallic effect. Aluminum flake pigments are one possible choice for preparing metallic silver toner due to their commercial availability and low cost. However, there are challenges regarding use of aluminum flake pigments to create metallic hue silver toners. For example, such toners may possess a low charge due to increased conductivity of the aluminum pigment. It is difficult to incorporate large aluminum metal flake pigment into toner. It is also difficult to optimize the orientation of aluminum flake pigment in order to achieve maximum metallic hue. Further, there are safety concerns with processing and handling of explosive aluminum powders. For example, in preparation of toner by conventional processes including melt mixing pigment into resin followed by grinding, classification, and additive blending, there is a danger of sparking from the conductive aluminum during the grinding step.

Thus, while currently available toners and toner processes are suitable for their intended purposes, there remains a need for an improved metallic toner and process for preparing same. There further remains a need for a viable process for preparing silver metallic toner.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner composition comprising a toner particle having a surface, wherein the toner particle comprises at least one toner resin; a metallic pigment bonded to the surface of the toner particle; and an insulative surface additive disposed over the metallic pigment.

Also described is a toner composition comprising a toner particle having a surface, wherein the toner particles comprises an amorphous polyester resin; a metallic pigment bonded to the surface of the toner particle; and an insulative surface additive disposed over the metallic pigment.

Also described is a toner composition comprising a toner particle having a surface, wherein the toner particle comprises an amorphous polyester resin; a metallic pigment bonded to the surface of the toner particle; and an insulative surface additive disposed over the metallic pigment.

DETAILED DESCRIPTION

Figure 1:
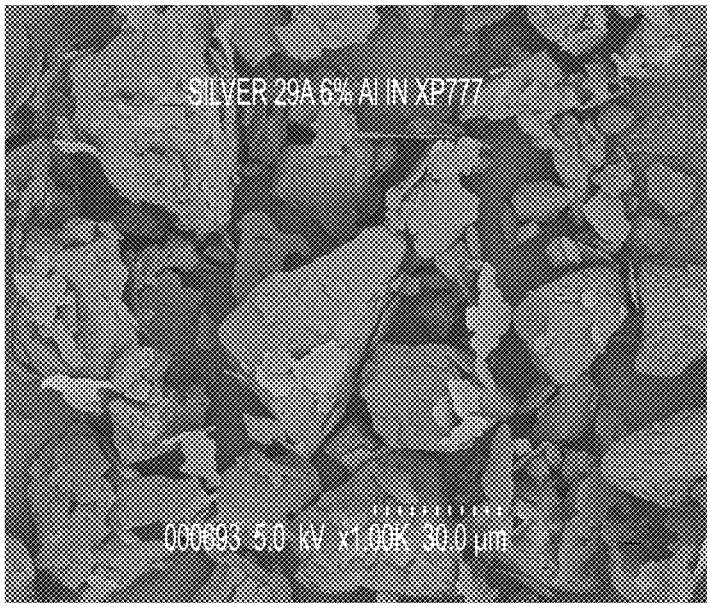
FIG. 1 is a Scanning Electron Micrograph image of a silver metallic toner having aluminum flakes bonded to the toner surface.

The present disclosure provides a toner composition comprising a toner particle having a surface; a metallic pigment bonded to the surface of the toner particle; and an insulative surface additive disposed over the metallic pigment.

The toner can be any suitable or desired toner including conventional toner prepared by mechanical grinding processes and chemical toner prepared by chemical processes such as emulsion aggregation and suspension polymerization. In embodiments, the toner is a conventional toner prepared by grinding and classification methods.

In some embodiments, the present disclosure provides a conventional (pulverized) toner formulation having aluminum flake metallic pigment bonded to the toner surface and further includes an insulative silicone oil surface additive to enable stable charging. The toner can be prepared by first manufacturing a clear conventional parent particle followed by bonding metallic aluminum flake onto the particle surface. The bonding of the aluminum flake to the toner surface can be done by any suitable or desired process. In embodiments, the metallic pigment is bonded to the surface of the toner resin particle by mechanical blending of aluminum pigment and the toner particle in a mixer, optionally at an elevated temperature.

Incorporating aluminum metallic flakes into toners can present safety issues. In embodiments, bonding of the aluminum flake can be done using the Blitz® Bonding process performed by SUN® Chemical, thereby reducing or eliminating altogether the safety issues associated with bonding metallic flake onto toner surfaces and safety issues associated with further processing of metallic toner.

In embodiments, the toner composition provides prints having exceptional metallic silver hue as characterized by high flop index. The wet deposition method has been used for many years to assess the color characteristics of different toner designs on the bench. Getting a conventional toner with exceptional metallic hue is very challenging as the flake needs to be both large enough and also properly oriented to reflect light. The toner composition of the present embodiments addresses these challenges.

In embodiments, bench charge measurements show stable charging characteristics as the silicone oil additive coats the flakes during additive blending and insulates the conductive aluminum flakes. Designing a metallic silver conventional toner having aluminum flakes bonded to the surface has been problematic and presented many issues including safety issues. Exposed aluminum pigment on the surface of the particle can lead to a more conductive toner surface that cannot retain charge as good as chemical toners that have a polymer shell encapsulating the flake. In embodiments herein, the toner composition includes an insulative surface additive, in embodiments, an insulative silicone oil surface additive, which stabilizes the toner charge characteristics. In embodiments, the toner composition herein includes a metallic pigment, wherein the metallic pigment is a metallic aluminum pigment bonded onto the surface of the toner particle. This is in contrast to previously available metallic toners wherein pigment is dispersed inside of the toner particle rather than on the surface.

Toner samples can be evaluated, such as by conditioning toner, or developer samples overnight in selected zones, such as A, B, and J zones and then charged using a Turbula mixer for about 60 minutes. The A zone is a high humidity zone at about 80° F. and 80% relative humidity (RH) and the J zone is a low humidity zone at about 70° F. and about 10% RH. B Zone is an ambient condition zone of about 50% RH at about 70° F. Toner charge (Q/d) can be measured using a charge spectrograph with a 100 V/cm field, and can be measured visually as the midpoint of the toner charge distribution. The toner charge per mass ratio (Q/m) can be determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/m ratio.

In embodiments, a toner composition herein has a toner charge of from about 9 to about 30 microcoulombs per gram in A Zone, from about 15 to about 40 microcoulombs per gram in B Zone, and from about 20 to about 60 microcoulombs per gram in J Zone.

In embodiments, a toner composition herein comprises a toner particle, wherein the toner particle comprises at least one toner resin; a metallic pigment bonded to a surface of the toner particle; and an insulative surface additive disposed over the metallic pigment.

Toner Resin.

Any suitable or desired resin can be selected for the toner particles. Suitable resins include amorphous low molecular weight linear polyesters, high molecular weight branched and crosslinked polyesters and crystalline polyesters. In embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, malonic acid, succinic acid, glutaric acid, adipic acid, pimelic acid, suberic acid, azelaic acid, sebacic acid, undecanedioic acid, dodecanedioic acid, 1,11-undecane dicarboxylic acid, 1,12-dodecane dicarboxylic acid, 1,13-tridecane dicarboxylic acid, 1,14-tetradecane dicarboxlic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(dodecylene-adipate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(dodecylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecandioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly (nonylene-fumarate), poly(decylene-fumarate), copolymers such as copoly(ethylene-fumarate)-copoly(ethylene-dodecandioate) and the like, alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly (octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly (ethylene-succinimide), poly(propylene-succinimide), and poly(butylene-succinimide).

The crystalline resin may be present, for example, in an amount of from about 5 to about 50 percent by weight of the toner components, in embodiments from about 5 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 2 to about 4.

Examples of diacid or diesters including vinyl diacids or vinyl diesters selected for the preparation of amorphous polyesters include dicarboxylic acids or diesters such as terephthalic acid, phthalic acid, isophthalic acid, fumaric acid, dimethyl fumarate, dimethyl itaconate, cis-1,4-diacetoxy-2-butene, diethyl fumarate, diethyl maleate, maleic acid, succinic acid, itaconic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, the resin may be formed by condensation polymerization methods. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, the polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly (ethoxylated bisphenol A-fumarate), poly(ethoxylated bisphenol A-succinate), poly(ethoxylated bisphenol A-adipate), poly(ethoxylated bisphenol A-glutarate), poly(ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol A co-fumarate), poly(ethoxylated bisphenol A co-fumarate), poly (butyloxylated bisphenol A co-fumarate), poly(co-propoxylated bisphenol A co-ethoxylated bisphenol A co-fumarate), poly(1,2-propylene fumarate), poly(propoxylated bisphenol A co-maleate), poly(ethoxylated bisphenol A co-maleate), poly(butyloxylated bisphenol A co-maleate), poly(co-propoxylated bisphenol A co-ethoxylated bisphenol A co-maleate), poly(1,2-propylene maleate), poly(propoxylated bisphenol A co-itaconate), poly(ethoxylated bisphenol A co-itaconate), poly(butyloxylated bisphenol A co-itaconate), poly(co-propoxylated bisphenol A co-ethoxylated bisphenol A co-itaconate), poly(1,2-propylene itaconate), and combinations thereof.

In embodiments, a suitable linear amorphous polyester resin may be a poly(propoxylated bisphenol A co-fumarate) resin having the following formula (I):

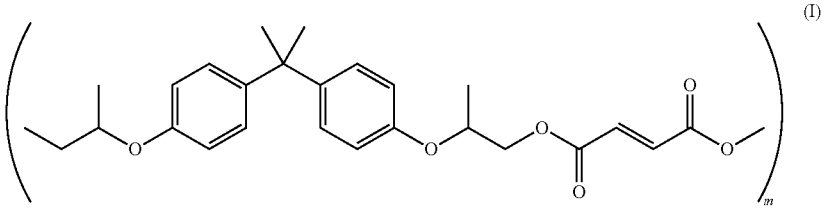

(I)

wherein m may be from about 5 to about 1000.

An example of a linear amorphous propoxylated bisphenol A fumarate resin which may be utilized as a latex resin is available under the trade name SPARII™ from Resana S/A Industrias Quimicas, Sao Paulo Brazil. Other suitable linear amorphous resins include those disclosed in U.S. Pat. Nos. 4,533,614, 4,957,774 and 4,533,614, which can be linear polyester resins including dodecylsuccinic anhydride, terephthalic acid, and alkyloxylated bisphenol A. Other alkoxylated bisphenol A terephthalate resins that may be utilized and are commercially available include GTU-FC115, commercially available from Kao Corporation, Japan, and the like.

Suitable crystalline resins include those disclosed in U.S. Pat. No. 7,329,476, U.S. Patent Application Publication Nos. 2006/0216626, 2008/0107990, 2008/0236446, and 2009/0047593 the disclosure of each of which is hereby incorporated by reference in its entirety. In embodiments, a suitable crystalline resin may include a resin composed of ethylene glycol and a mixture of dodecanedioic acid and fumaric acid co-monomers with the following formula:

(II)

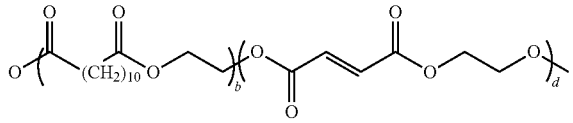

wherein b is from 5 to 2000 and d is from 5 to 2000.

For example, in embodiments, a poly(propoxylated bisphenol A co-fumarate) resin of formula I as described above may be combined with a crystalline resin of formula II to form a core.

In embodiments, the amorphous resin or combination of amorphous resins utilized in the core may have a glass transition temperature of from about 30° C. to about 80° C., in embodiments from about 35° C. to about 70° C. In further embodiments, the combined resins utilized in the core may have a melt viscosity of from about 10 to about 1,000,000 Pa*S at about 130° C., in embodiments from about 50 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In one embodiment, the amorphous polyester resin is present in an amount of from about 50% to about 85% by weight based upon the total weight of the toner.

In embodiments, linear amorphous polyesters may be combined with a high molecular weight branched or cross-linked amorphous polyesters to provide improved toner properties such as higher hot offset temperatures and control of print gloss properties. This high molecular weight polyester may include, in embodiments, for example, a branched resin or polymer, a cross-linked resin or polymer, or mixtures thereof, or a non-cross-linked resin that has been subjected to cross-linking. In accordance with the present disclosure, from about 1% by weight to about 100% by weight of the higher molecular weight resin may be branched or cross-linked, in embodiments from about 2% by weight to about 50% by weight of the higher molecular weight resin may be branched or cross-linked. As used herein, the term "high molecular weight resin" refers to a resin wherein the weight-average molecular weight (Mw) of the chloroform-soluble fraction of the resin is above about 15,000 and a polydispersity index (PD) above about 4, as measured by gel permeation chromatography versus standard polystyrene reference resins. The PD index is the ratio of the weight-average molecular weight (Mw) and the number-average molecular weight (Mn).

The high molecular weight amorphous polyester resins may prepared by branching or cross-linking linear polyester resins. Branching agents can be utilized, such as trifunctional or multifunctional monomers, which agents usually increase the molecular weight and polydispersity of the polyester. Suitable branching agents can include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539, the disclosures of each of which are incorporated by reference in their entirety.

In embodiments, cross-linked polyesters resins may be made from linear polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, fumaric acid, and the like, and combinations thereof, and diols such as, for example, propoxylated bisphenol A, propylene glycol, and the like, and combinations thereof. In embodiments, a suitable polyester is poly(propoxylated bisphenol A fumarate).

In embodiments, the high molecular weight branched or cross-linked polyester resin has a Mw of greater than about 15,000, in embodiments from about 15,000 to about 1,000,000, in other embodiments from about 20,000 to about 100,000, and a polydispersity index (Mw/Mn) of greater than about 4, in embodiments from about 4 to about 100, in other embodiments from about 6 to about 50, as measured by GPC versus standard polystyrene reference resins.

In embodiments, a cross-linked branched polyester may be utilized as a high molecular weight resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference in its entirety.

In embodiments, branched polyesters may include those resulting from the reaction of dimethylterephthalate, 1,3-butanediol, 1,2-propanediol, and pentaerythritol.

Suitable polyols may contain from about 2 to about 100 carbon atoms and have at least two or more hydroxy groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% weight of the reaction mixture, in embodiments, from about 20% to about 26% weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a $C_3$ to $C_6$ cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% weight of the reaction mixture, in embodiments, from about 44% to about 60% weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted napthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

The amount of high molecular weight resin in a toner particle of the present disclosure, whether in the core, the shell, or both, may be from about 1% to about 30% by weight of the toner, in embodiments from about 2.5% to about 20% by weight, or from about 5% to about 10% by weight of the toner.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 110 nanometers to about 150 nanometers. The high molecular weight resin particles may cover from about 10% to about 90% of the toner surface, in embodiments from about 20% to about 50% of the toner surface.

Toner.

The resins described above may be utilized to form toner compositions. Such toner compositions may include optional colorants, optional, and other additives. Toners may be formed utilizing any method within the purview of those skilled in the art.

In a specific embodiment, the toners herein are conventional toners prepared by combination, pulverizing, grinding, and classification processes. This is distinguished from chemical toners prepared using processes such as emulsion aggregation or suspension polymerization, for example.

Metallic Pigment.

The toner compositions contain a metallic pigment. Any suitable or desired metallic pigment can be selected. In embodiments, the metallic pigment is selected from the group consisting of aluminum, zinc, copper-zinc alloys, and combinations thereof. In a specific embodiment, the metallic pigment comprises aluminum flake.

In embodiments, the toner is free of additional colorant, that is, the toner does not contain, any colorant other than the metallic pigment.

The metallic pigment can be present in any suitable or desired amount. In embodiments, the metallic pigment is present in an amount of from about 0.1 to about 10 percent, or from about 1 to about 8 percent, or from about 2 to about 6 percent by weight, based on the total weight of the toner composition.

The metallic pigment is bonded to the surface of the parent toner particle. Bonding can be accomplished by any suitable or desired process. In embodiments, the metallic pigment is bonded to the surface of the toner resin particle by mechanical blending of aluminum pigment and the toner particle in a mixer. In embodiments, the blending process could be done at elevated temperature (in embodiments, at a temperature of about 50 to about 150 Fahrenheit) to increase attachment of the aluminum flake pigment to the toner particle surface.

Insulative Surface Additives.

In embodiments, the toner includes an insulative surface additive. The insulative surface additive can be disposed over the metallic pigment that is bonded to the toner.

Any suitable or desired insulative surface additive can be selected. In embodiments, the insulative surface additive is selected from the group consisting of mineral oil, long chain fatty acids, and silicone oil. In a specific embodiment, the insulative surface additive is silicone oil. In embodiments, long chain fatty acids are fatty acids having aliphatic carbon tails having from about 13 to about 21 carbon atoms, or longer aliphatic carbon tails having about 22 carbon atoms or more.

The insulative surface additive can be provided in any suitable or desired amount. In embodiments, the insulative surface additive is present in an amount of from about 0.1 to about 2 percent, or from about 0.5 to about 1.5 percent, or from about 0.15 to about 0.3 percent by weight, based on the total weight of the toner.

Surface Additives.

The toner composition of the present embodiments may include one or more surface additives in addition to the insulative surface additive. The surface additives are coated onto the surface of the toner particles, which may provide a total surface area coverage of from about 50% to about 99%, from about 60% to about 90%, or from about 70% to about 80% of the toner particle. The toner composition of the present embodiment may include from about 2.7% to about 4.0%, from about 3.0% to about 3.7%, or from about 3.1% to about 3.5% of surface additive based on the total weight on the toner.

The surface additives may include silica, titania and stearates. The charging and flow characteristics of a toner are influenced by the selection of surface additives and concentration of such in the toner. The concentration of surface additives and their size and shape control the arrangement of these on the toner particle surface. In embodiments, the silica includes two coated silicas. More specifically, one of the two silicas may be a negative charging silica, and the other silica may be a positive charging silica (relative to the carrier). By negatively charging is meant that the additive is negatively charging relative to the toner surface measured by determining the toner triboelectric charge with and without the additive. Similarly, by positively charging is meant that the additives are positively charging relative to the toner surface measured by determining the toner triboelectric charge with and without the additive.

An example of the negative charging silica include NA50HS obtained from DeGussa/Nippon Aerosil Corporation, which is a fumed silica coated with a mixture of hexamethyldisilazane and aminopropyltriethoxysilane (having approximately 30 nanometers of primary particle size and about 350 nanometers of aggregate size).

An example of the relatively positive charging silica include H2050 silica with polydimethylsiloxane units or segments, and having amino/ammonium functions chemically bonded onto the surface of highly hydrophobic fumed silica, and which coated silica possesses a BET surface area of about 110 to about ±20 m2/g (obtained from Wacker Chemie).

The negative charging silica may be present in an amount from about 1.6% to about 2.4%, from about 1.8% to about 2.2%, from about 1.9% to about 2.1%, by weight of the surface additives.

The positive charging silica may be present in an amount from about 0.08% to about 1.2%, from about 0.09% to about 0.11%, from about 0.09% to about 0.1%, by weight of the surface additives.

The ratio of the negatively charging silica to the positively charging silica ranges from, for example, about 13:1 to about 30:1, or from about 15:1 to about 25:1, weight basis.

The surface additives may also include a titania. The titania may be present in an amount from about 0.53% to about 0.9%, from about 0.68% to about 0.83%, from about 0.7% to about 0.8%, by weight of the surface additives. A suitable titania for use herein is, for example, SMT5103 available from Tayca Corp., a titania having a size of about 25 to about 55 nm treated with decylsilane.

The weight ratio of the negative charging silica to the titania is from about 1.8:1 to about 4.5:1, from about 2.2:1 to about 3.2:1, or from about 2.5:1 to about 3.0:1.

The surface additives may also include a lubricant and conductivity aid, for example a metal salt of a fatty acid such as, e.g., zinc stearate, calcium stearate. A suitable example includes Zinc Stearate L from Ferro Corp., or calcium stearate from Ferro Corp. Such a conductivity aid may be present in an amount from about 0.10% to about 1.00% by weight of the toner.

In another preferred embodiment, the toner and/or surface additive also includes a conductivity aid, for example a metal salt of a fatty acid such as, e.g., zinc stearate. A suitable example includes Zinc Stearate L from Ferro Corp. Such a conductivity aid may be present in an amount from about 0.10% to about 1.00% by weight of the toner.

The clear toner compositions of the present embodiments can be prepared by mixing, for example, melt mixing, and heating resin particles in a toner extrusion device, such as the ZSK25 available from Werner Pfleiderer, and removing the formed toner composition from the device. Subsequent to cooling, the toner composition is subjected to grinding utilizing, for example, a Sturtevant micronizer, reference U.S. Pat. No. 5,716,751, the disclosure of which is totally incorporated herein by reference. Subsequently, the toner compositions can be classified utilizing, for example, a Donaldson Model B classifier for the purpose of removing fines, that is, the particles are accompanied by very low levels of fine particles of the same material. For example, the levels of fine particles is in the range of from about 0.1% to about 3% by weight of the toner. After removing the excess fines content, the clear toner may have a mean particle size of from about 6 microns to about 8 microns, from about 6.5 microns to about 7.5 microns, or about 7.0 microns. The GSD refers to the upper geometric standard deviation (GSD) by volume (coarse level) for (D84/D50) and can be from about 1.10 to about 1.30, or from about 1.15 to about 1.25, or from about 1.18 to about 1.21. The geometric standard deviation (GSD) by number (fines level) for (D50/D16) can be from about 1.10 to about 1.30, or from about 1.15 to about 1.25, or from about 1.22 to about 1.24. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution. The particle diameters are determined by a Multisizer III.

Thereafter, the insulative surface additive and other additives can be added by the blending thereof with the toner obtained. The term "particle size," as used herein, or the term "size" as employed herein in reference to the term "particles," means volume weighted diameter as measured by conventional diameter measuring devices, such as a Multisizer III, sold by Coulter, Inc. Mean volume weighted diameter is the sum of the mass of each particle times the diameter of a spherical particle of equal mass and density, divided by total particle mass.

The size distribution and additive formulation of the toner is such that it enables the toner to be operated in a system providing offset lithography at a very low mass target while still providing sufficient coverage of the substrate. In this context, the mass target refers to concentration of toner particles that are developed or laid on the substrate (i.e. paper or other substrate) per unit area of substrate. The size distribution and additive formulation of the toner is such that it enables the system to operate at a mass target of 0.3 to 0.4 mg of toner per square centimeter of substrate. The rheology of the toner of the present embodiments is also designed to maximize the gloss and reduce the risk of toner offset to the fuser with the fuser roll used in the system.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Production of the metallic silver toner started with the manufacture of clear parent particles by extruding the raw materials in a ZSK-25 extruder, available from Werner & Pfleiderer Corporation, Ramsey, N.J. The toner composition comprises a mix consisting of various levels of a propoxylated Bisphenol-A/Fumaric Acid resin having a molecular weight (Mw) of around 13000 grams/mol, available under the tradename Resapol® from Reichold), and 10 to 30 weight % of a cross-linked gel resin prepared by crosslinking the propoxylated Bisphenol-A/Fumaric Acid resin as described in U.S. Pat. No. 6,359,105, which is hereby incorporated by reference herein in its entirety. The resulting extrudates were pulverized in a 200 AFG fluid bed jet mill to a target median size D50 of 8.5 and 21 microns. The target particle size was selected to enable a mean size of around 8.5 and 21 microns after removing the excess fines content. 0.3% TS530 surface treated fumed silica, Cabosil Corporation silica was added during the pulverization process as a flow aid. The particles were classified in a B18 Tandem Acucut® classifier system produced by Micron Powder Systems. Examples 1 and 2 were silver toner particles made using the toner particles synthesized as described above.

Examples 1 and 2 were prepared using these two clear parent particles, 21 micron and 8.5 micron, respectively. Aluminum flake pigment was surface bonded to the clear parent particles of Example 1 and Example 2 (using the Blitz® Bonding method of SUN Chemical (Benda-Lutz) to coat the aluminum flake pigment and surface bond the pigment to the parent particles. The metallic flake was bonded to the toner surface instead of being encapsulated within the resin particle. There is no separation of coating. Advantages of this method include high metallic effect (bulk powder), no separation of coating, cost benefit for large quantities, less pigment required, in embodiments, about 6% percent, or up to 6 percent total pigment, safer handling of aluminum powder, and no need to extrude, pulverize, and classify powder.

Example 1

A 21 micron particle having 6% w/w aluminum flake bonded to surface prepared as described above.

Example 2

An 8.5 micron particle having 2% w/w aluminum flake bonded to surface prepared as described above.

Comparative Example 3

A Silver toner for Fuji Xerox® ColorPress machine commercially available from Fuji Xerox Co. Ltd.

FIG. 1 shows a representative Scanning Electron Micrograph image of silver metallic toner having aluminum flakes bonded to the toner surface.

Metallic Hue Evaluation.

The two silver toner particles of Example 1 and Example 2 were evaluated for metallic hue using Wet Deposition technique to create toner layer samples. Wet deposition samples were created by dispersing the toner particles in water and then filtering toner suspensions at different concentrations through a filter to yield known mass of toner layer per unit area of the filter (mg/cm$^2$). This is a good bench simulation of TMA of the Xerographic process and has been used by Xerox® for color analysis of toners extensively. The toner layer on filter is then fused and is evaluated on BYK Mac-i multi-angle spectrophotometer for metallic hue properties.

Flop Index.

Flop Index is the measurement on the change in reflectance of a metallic color as it is rotated through the range of viewing angles. A flop index of 0 indicates a solid color, while a very high flop index, for example, 15-17, indicates a metallic or pearlescent basecoat/clearcoat.

$$\text{Flop Index} = \frac{2.69(L*15° - L*110°)^{1.11}}{L*45°)^{0.88}}$$

wherein L* is the luminous intensity of a color—i.e., its degree of lightness. Lightness means brightness of an area judged relative to the brightness of a similarly illuminated area that appears to be white or highly transmitting.

Figure 2:
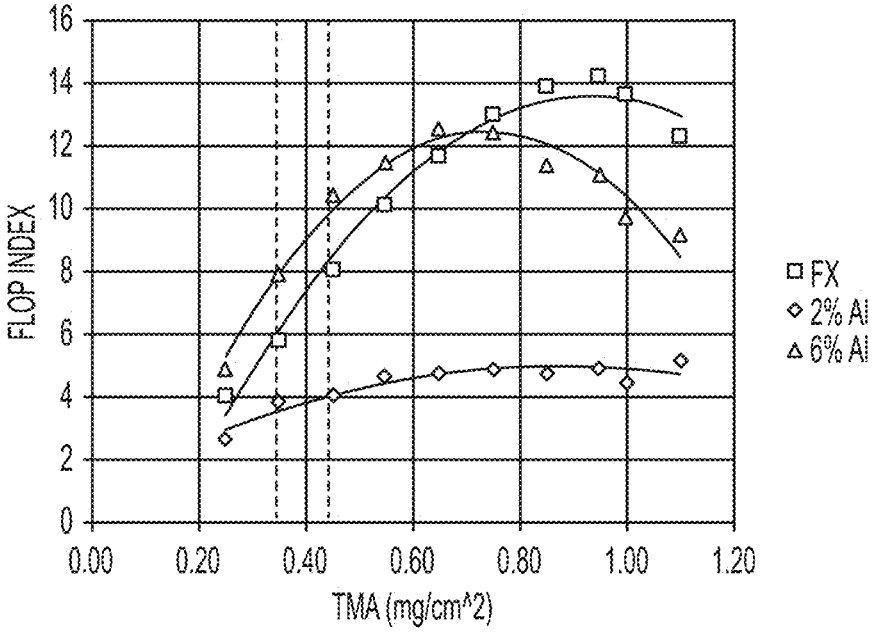
FIG. 2 is a graph showing Flop Index (y-axis) versus TMA (mg/cm$^2$, x-axis) for two toner compositions in accordance with the present embodiments and a comparative toner composition.

FIG. 2 is a graph showing Flop Index (y-axis) versus TMA (mg/cm$^2$, x-axis) for two toner compositions in accordance with the present embodiments and a comparative toner composition. As shown in FIG. 2, the 20 micron particle with 6% Aluminum of Example 1 has equal or better Flop Index Compared to FX silver particle of Comparative Example 3. It also saturates at a much lower mass target. The smaller size particle of Example 2 with low Aluminum content had a low Flop Index consistent with lower (2%) flake loading. Xerographic printer machine operating at TMA ranges of ~0.3 to 0.6 mg/cm$^2$, with 0.45 TMA being the nominal setpoint.

Surface Additive Blending.

Example 4 and Example 5

Silver Parent particle Example 2 (8.5 micron size/2% Al flakes) was blended in a 75 L Henschel Vertical Mixer with surface additives to generate toner blends.

Example 4: The initial additive packaged used is one composed of 3.14% silica, 1.29% Titania, and 0.5% zinc stearate.

Example 5. Another toner blend was made having an additional oil additive 0.3% of a silicone oil X82 from Wacker Chemie.

A metallic toner with Al flakes bonded to the surface may lead to a more conductive toner surface that cannot retain charge as good as chemical toners that have a polymer shell encapsulating the flake. This may result in lower charging. In embodiments, an insulative oil coating on the metallic flakes improved charging characteristics. The triboelectric charging of these two toners was measured on the bench under different environmental conditions of A, B and J zone. The A zone is a high humidity zone at about 80° F. and 80% relative humidity (RH) and the J zone is a low humidity zone at about 70° F. and about 10% RH. B Zone is an ambient condition zone of about 50% RH at about 70° F. The data was generated by pairing the toners against a steel core carrier using the paint shake method at 4% TC. Table 1 shows the results of bench Tribo. Charge is in microcoulombs/gram.

TABLE 1

| Example | Base Formulation | A Zone Charge | B Zone Charge | J Zone Charge |
|---|---|---|---|---|
| 4 | Example 1 | 12.03 | 24.12 | 32.51 |
| 5 | Example 1 with 0.3% X82 Oil | 15.83 | 28.83 | 37.05 |

The Triboelectric charge data shows the silver toner control to be on the lower side, but within the range observed for other colors that are currently run in this system. Small tribo adjustments can be enabled by optimizing the operating TC (toner concentration) of the system and additive level optimization. In addition, adding 0.3% of a silicone oil as surface additive increased the toner Tribo by about 4-5 units. We also compared charging rates of the control and 0.3% oil silver toners.

Figure 3:
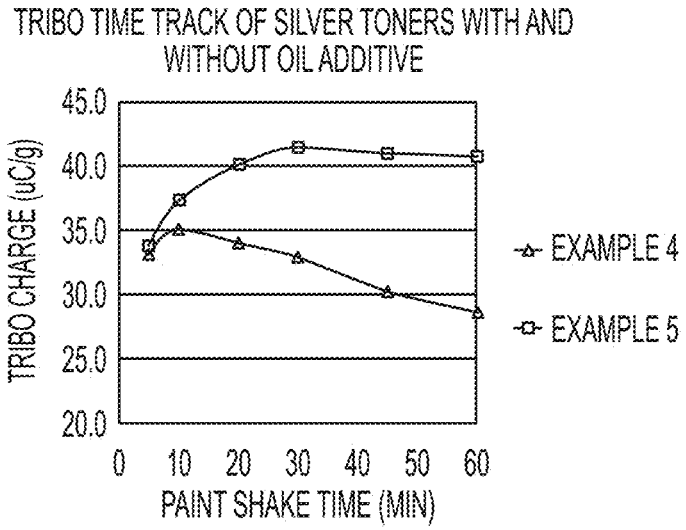
FIG. 3 is a graph showing Tribo Charge (μC/g, y-axis) versus paint shake time (minutes, x-axis) for silver toners with and without oil additives.

FIG. 3 is a graph showing Tribo Charge in microcoulombs/gram (μC/g, y-axis) versus paint shake time (minutes, x-axis) for silver toners of Examples 4 (no oil) and 5 (with oil additives) in J Zone. The line indicated by the triangles show the silver toner of Example 4 having no oil additive. The line indicated by the squares shows the silver toner of Example 5 having 0.3% X82 oil additive.

As can be seen clearly, adding small 0.3% of surface oil additive substantially improved the metallic toners charging rate. Hence, in embodiments, oil, as a surface additive provides more stable charging in toners having metal flakes. This may become important in toner designs having higher % of Al flakes which show very low charge.

Thus, in embodiments, a conventional toner is provided which enables high metallic hue effect as indicated by high flop index. Aluminum flakes bonded to the surface of the toner enable ease of manufacture and keep flakes properly oriented on toner for maximum metallic hue. In embodiments, an insulative silicone oil surface additive enables higher loading of conductive aluminum flake pigments and increases and stabilizes toner charging.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner composition comprising:

a toner particle having a surface, wherein the toner particle comprises at least one toner resin;

a metallic pigment bonded to the surface of the toner particle; and an insulative surface additive disposed over the metallic pigment;

wherein the insulative surface additive is silicone oil.

2. The toner composition of claim 1, wherein the toner resin is selected from the group consisting of a crystalline polyester, an amorphous polyester, and combinations thereof.

3. The toner composition of claim 1, wherein the toner resin is an amorphous polyester resin selected from the group consisting of propoxylated bisphenol A fumarate resin, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a ter-poly(propoxylated bisphenol A co-fumarate)-terpoly (propoxylated bisphenol A co-terephthalate)-terpoly-(propoxylated bisphenol A co-dodecylsuccinate), and combinations thereof.

4. The toner composition of claim 1, wherein the toner resin is an amorphous polyester resin comprising propoxylated bisphenol A fumarate resin.

5. The toner composition of claim 1, wherein the toner resin is a poly(propoxylated bisphenol A co-fumarate) resin having the formula

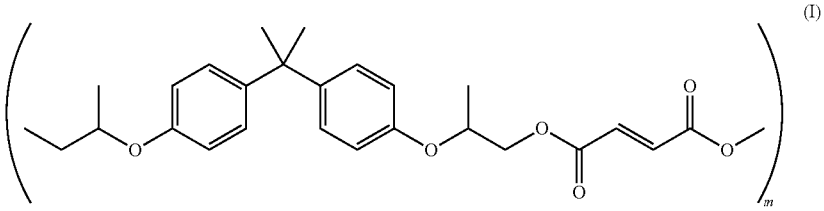

(I)

wherein m is from about 5 to about 1000.

6. The toner composition of claim 1, wherein the metallic pigment is selected from the group consisting of aluminum, zinc, copper-zinc alloy, and combinations thereof.

7. The toner composition of claim 1, wherein the metallic pigment is aluminum flake.

8. The toner composition of claim 1, wherein the toner has a Flop Index of from about 4 to about 15;

Flop Index having the formula $$\text{Flop Index} = \frac{2.69(L*15^\circ - L*110^\circ)^{1.11}}{L*45^\circ)^{0.88}}$$

wherein L* is the luminous intensity of a color.

9. The toner composition of claim 1, wherein the metallic pigment is a metallic aluminum pigment bonded onto the surface of the toner particle.

10. The toner composition of claim 1, wherein the toner is prepared by a process comprising:

providing at least one toner resin;

optionally, melting, kneeding, and cooling the at least one toner resin;

grinding to achieve a parent toner particle;

disposing a metallic pigment onto a surface of the parent toner particle, wherein the metallic pigment is bonded to the surface of the parent toner particle; and, disposing an insulative surface additive over the metallic pigment, wherein the insulative surface additive is silicone oil.

11. A toner composition comprising:

a toner particle having a surface, wherein the toner particles comprises an amorphous polyester resin;

a metallic pigment bonded to the surface of the toner particle; and an insulative surface additive disposed over the metallic pigment;

wherein the insulative surface additive is silicone oil.

12. The toner composition of claim 11, wherein the metallic pigment is selected from the group consisting aluminum, zinc, copper-zinc alloy, and combinations thereof.

13. The toner composition of claim 11, wherein the metallic pigment is aluminum flake.

14. A toner process comprising:

providing at least one toner resin;

optionally, melting, kneeding, and cooling the at least one toner resin;

grinding to achieve a parent toner particle;

disposing a metallic pigment onto a surface of the parent toner particle, wherein the metallic pigment is bonded to the surface of the parent toner particle; and, disposing an insulative surface additive over the metallic pigment, wherein the insulative surface additive is silicone oil.

15. The toner process of claim 14, wherein the metallic pigment is selected from the group consisting aluminum, zinc, copper-zinc alloy, and combinations thereof.

* * * * *